US005357166A

United States Patent [19]

Sugahara et al.

[11] Patent Number: 5,357,166

[45] Date of Patent: Oct. 18, 1994

[54] CATHODE-RAY TUBE HAVING ALTERNATING ELECTRIC FIELD REDUCTION DEVICE

[75] Inventors: Takashi Sugahara; Kiyohiko Sato, both of Nagaokakyo, Japan

[73] Assignee: Mitsubishi Denki Kabushiki Kaisha, Tokyo, Japan

[21] Appl. No.: 870,088

[22] Filed: Apr. 17, 1992

[30] Foreign Application Priority Data

Apr. 18, 1991 [JP] Japan ..... 3-116902
Dec. 6, 1991 [JP] Japan ..... 3-349720

[51] Int. Cl.[5] ..... H01J 29/06; H01J 29/86
[52] U.S. Cl. ..... 313/479; 313/313
[58] Field of Search ..... 313/479, 313; 358/248, 358/245, 247; 315/85

[56] References Cited

U.S. PATENT DOCUMENTS

| | | | |
|---|---|---|---|
| 4,217,521 | 8/1980 | Dietch et al. | 313/479 |
| 4,392,083 | 7/1983 | Costello | 315/85 |
| 4,564,786 | 1/1986 | Baum et al. | 313/479 |
| 4,786,973 | 11/1988 | Lock et al. | 358/248 |
| 4,988,915 | 1/1991 | Zegers | 313/479 |
| 5,025,490 | 6/1991 | Tamura | 313/479 |

FOREIGN PATENT DOCUMENTS

| | | |
|---|---|---|
| 0085238 | 8/1983 | European Pat. Off. . |
| 283128A1 | 9/1988 | European Pat. Off. . |
| 298582A1 | 1/1989 | European Pat. Off. . |
| 323118A2 | 7/1989 | European Pat. Off. . |
| 0335680 | 10/1989 | European Pat. Off. . |
| 58-37657 | 9/1981 | Japan . |
| 59-967511 | 6/1984 | Japan . |
| 61-135027 | 6/1986 | Japan . |
| 1573692 | 8/1980 | Netherlands . |
| 309701 | 9/1955 | Switzerland . |
| 1513809 | 12/1975 | United Kingdom . |
| 2161320A | 1/1986 | United Kingdom . |

*Primary Examiner*—Sandra L. O'Shea

[57] ABSTRACT

In a cathode-ray tube, in order to readily and inexpensively reduce an alternating electric field irradiated by a deflection yoke to a front of the cathode-ray tube through a funnel part and a face panel, a conductive film for forming an electric field shield is formed from a neck part to a cone part of a glass bulb and is electrically connected to another conductive film formed on a funnel body part. The deflection yoke is mounted on the conductive film via an insulation sheet interposed therebetween. The conductive film is grounded to form an equipotential surface of 0 V in front of the deflection yoke. A transparent conductive film can be also formed on the external surface of the face panel to raise the reduction of the alternating electric field.

17 Claims, 14 Drawing Sheets

CATHODE-RAY TUBE HAVING ALTERNATING ELECTRIC FIELD REDUCTION DEVICE

BACKGROUND OF THE INVENTION i) Field of the Invention

The present invention relates to a cathode-ray tube having a reduction device of an alternating electric field emitted by a deflection yoke.

ii) Description of the Related Arts

In FIG. 1, there is shown a conventional cathode-ray tube. In this cathode-ray tube, a funnel part 1 is composed of a neck part 1*a*, a cone part 1*b* and a funnel body part 1*c* having a high voltage anode button 1*d* and is secured to a panel part 2 by using a frit seal. A neck seal line 1*e* is a coupling part for connecting the neck part 1*a* and the cone part 1*b* and is formed of glass somewhat thin in thickness, and thus is a weak part compared with other parts. As described above, the funnel part 1 and the panel part 2 constitute a glass bulb 20. An electron gun 3 is mounted and sealed within the neck part 1*a*. An implosion-protection band 4 for ensuring an implosion-proof property is wound around the side surfaces of the panel part 2, and four latch members 4*a*, for suspending the glass bulb 20 within a box frame (not shown), are integrally formed at the four corner portions of the band 4. A silicon resin film 5 for insulation is formed around the high voltage anode button 1*d* provided on the funnel body part 1*c*, and a conductive film 6 for adding a capacitance to the cathode-ray tube is formed on an external surface of the funnel body part 1*c*. This conductive film 6 is usually formed by applying graphite. A numeral 28 denotes a tube axial of a straight line parallel with the neck part 1*a*.

As shown in FIG. 2, a deflection yoke 7 for deflecting the electron beam is mounted on the above-described cathode-ray tube between the cone part 1*b* and the neck part 1*a*. As shown in FIG. 3, the deflection yoke 7 is composed of a horizontal deflection coil 7*a*, a vertical deflection coil 7*b* and a deflection yoke body part 7*c*.

The operation of the above-described cathode-ray tube will be described. That is, when the electron beam is irradiated by the electron gun 3 sealed within the neck part 1*a*, and the irradiated electron beam is deflected a predetermined amount in the horizontal and vertical directions by the horizontal deflection coil 7*a* and the vertical deflection coil 7*b* of the deflection yoke 7 to scan on a fluorescent film formed on the internal surface of the panel part 2. As a result, a desired image is projected on the panel part 2. At this time, the deflection width is in inverse proportion to a square root of a voltage applied to the high voltage anode button 1*d*.

In the conventional cathode-ray tube described above, no measures for shielding an alternating electric field radially generated around the deflection yoke during the deflection of the electron beam by the deflection yoke are provided. Thus the alternating electric field harmful to the human body permeates the funnel part 1 and the panel part 2 of the cathode-ray tube to irradiate forwards from the cathode-ray tube.

For reducing an influence on a radiation line of the electron beam due to a leakage magnetic field from a flyback transformer and the like, for example, as disclosed in Japanese Patent Laid-Open No. Sho 61-138433, a covering member for annularly covering a focusing electrode system constituting an electron gun by using a non-magnetic conductive magnetic shield body has been proposed. However, this covering member does not pay any consideration to the alternating electric field and can not reduce the alternating electric field as before.

SUMMARY OF THE INVENTION

It is therefore an object of the present invention to provide a cathode-ray tube in view of the problems of the prior art, which is capable of reducing an alternating electric field irradiated from a deflection yoke to the front of the cathode-ray tube.

According to the present invention, the object is achieved by providing alternating electric field reduction means for reducing an alternating electric field irradiated from a deflection yoke to a front surface of a face panel through a funnel part in a predetermined area extending from a cone part where the deflection yoke is set to a neck part of the funnel part in the cathode-ray tube.

More specifically, a grounded conductive film is formed on the predetermined area of a surface of the funnel part, and an insulator is formed on a surface of the conductive film for electrically isolating the deflection yoke from the conductive film.

In the construction described above, an equipotential surface of 0 V, i.e., an electric field shielding surface of plane is formed on an internal surface of an opening part of the deflection yoke, and thus the alternating electric field irradiated to the front surface of the face panel through the funnel part and the face panel can be reduced.

Further, a grounded transparent conductive film is formed on the external surface of the face panel to form an electric field shielding plane on the surface of the face panel, and thus the alternating electric field irradiated from the deflection yoke to the front surface of the face panel through the funnel part and the face panel can be further reduced.

Furthermore, a grounded conductive film is formed on an external surface of the cone part from a first area having a larger diameter than an open diameter of a horizontal deflection coil of the deflection yoke to a second area apart frontwards from a connection between the neck part and the cone part. Hence, a shield plane for sufficiently shielding the alternating electric field irradiated from the front part of the deflection yoke can be formed, and the neck seal line part having a thin glass thickness and thus a weak strength is kept to be a large electric resistance. Thus, it can be prevented to concentrate the electric field to the local low resistance position to maintain the reliability of the cathode-ray tube.

BRIEF DESCRIPTION OF THE DRAWINGS

The above and other objects, features and advantages of the present invention will more fully appear from the following description of the preferred embodiments with reference to the accompanying drawings, in which.

DESCRIPTION OF THE PREFERRED EMBODIMENTS

Figure 1:
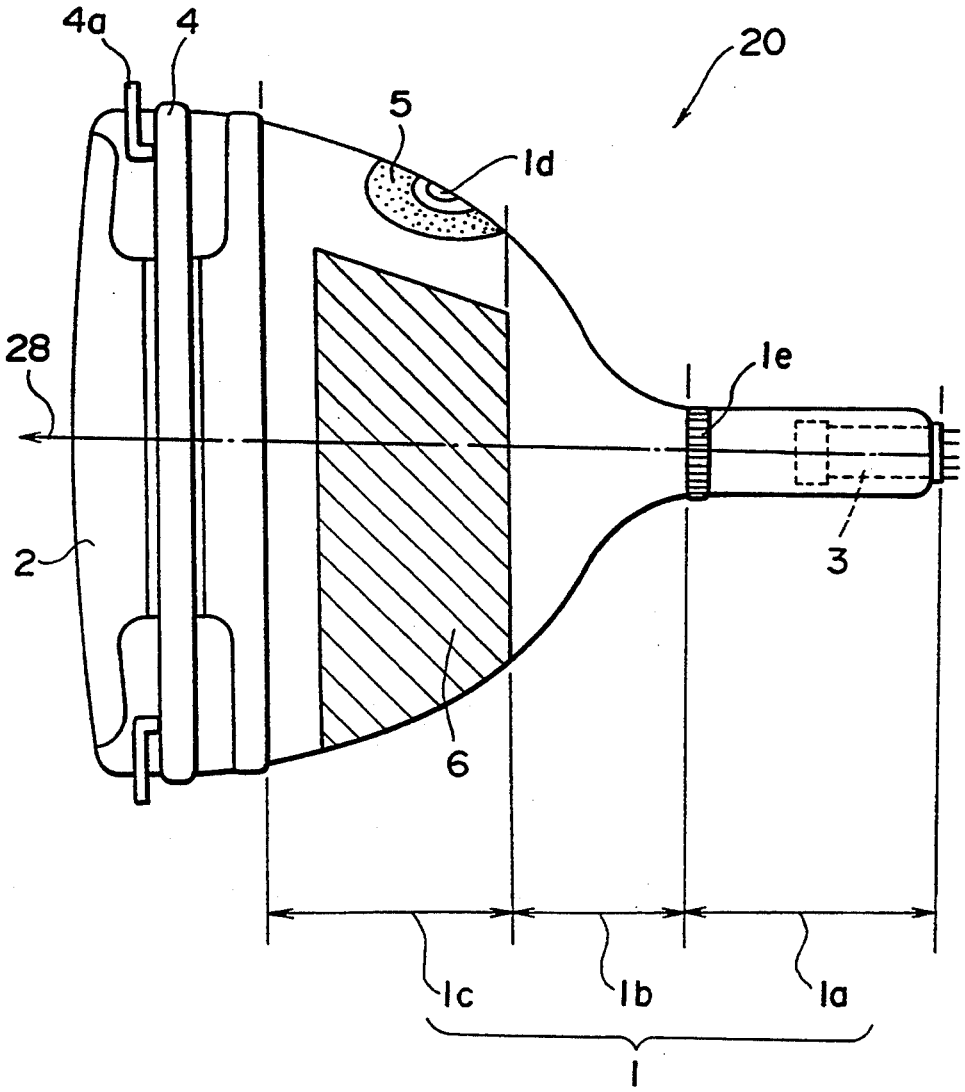
FIG. 1 PRIOR ART
FIG. 1 is a side view of a conventional cathode-ray tube before a deflection yoke is mounted thereon.

The present invention will now be described in connection with its preferred embodiments with reference to the attached drawings, wherein like reference characters designate like or corresponding parts throughout the views and thus the repeated description thereof can be omitted for brevity.

Figure 2:
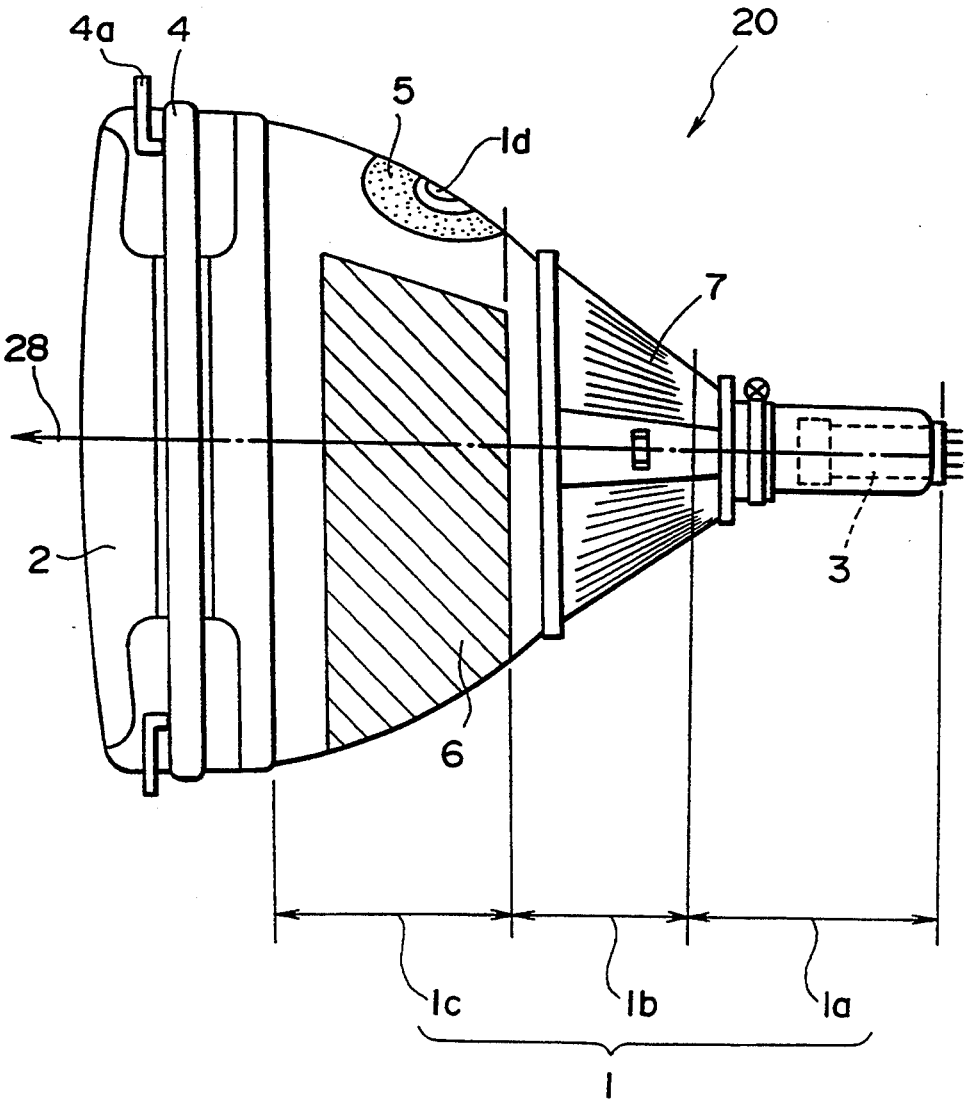
FIG. 2 PRIOR ART
FIG. 2 is a side view of the conventional cathode-ray tube shown in FIG. 1 after the deflection yoke is mounted thereon.
Figure 3:
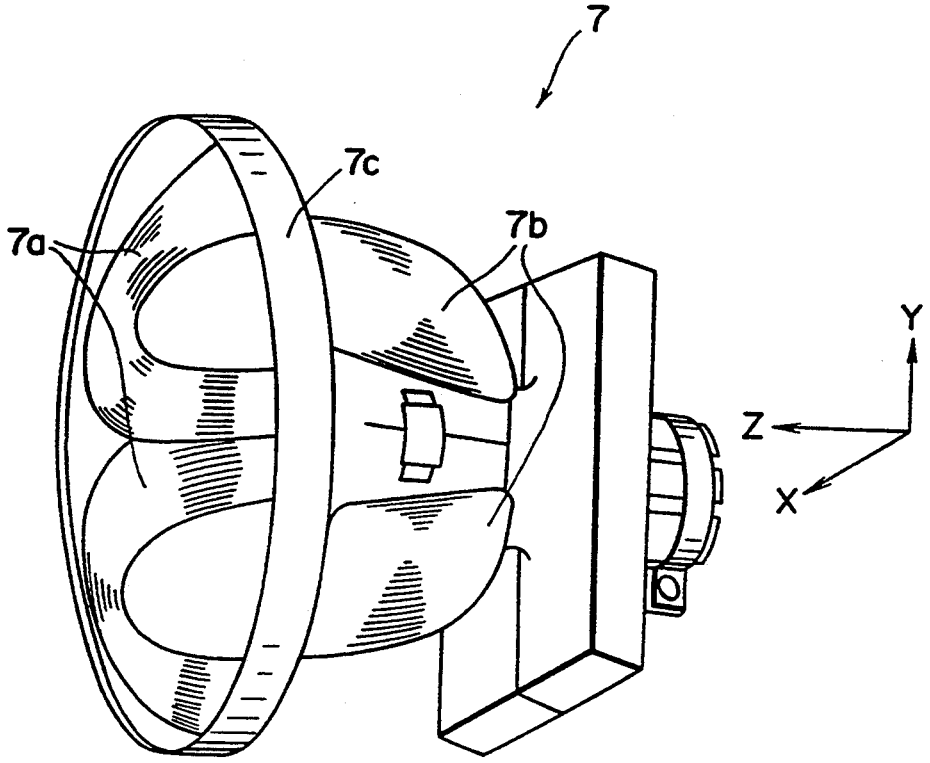
FIG. 3 PRIOR ART
FIG. 3 is a perspective view of a deflection yoke shown in FIG. 2.
Figure 4:
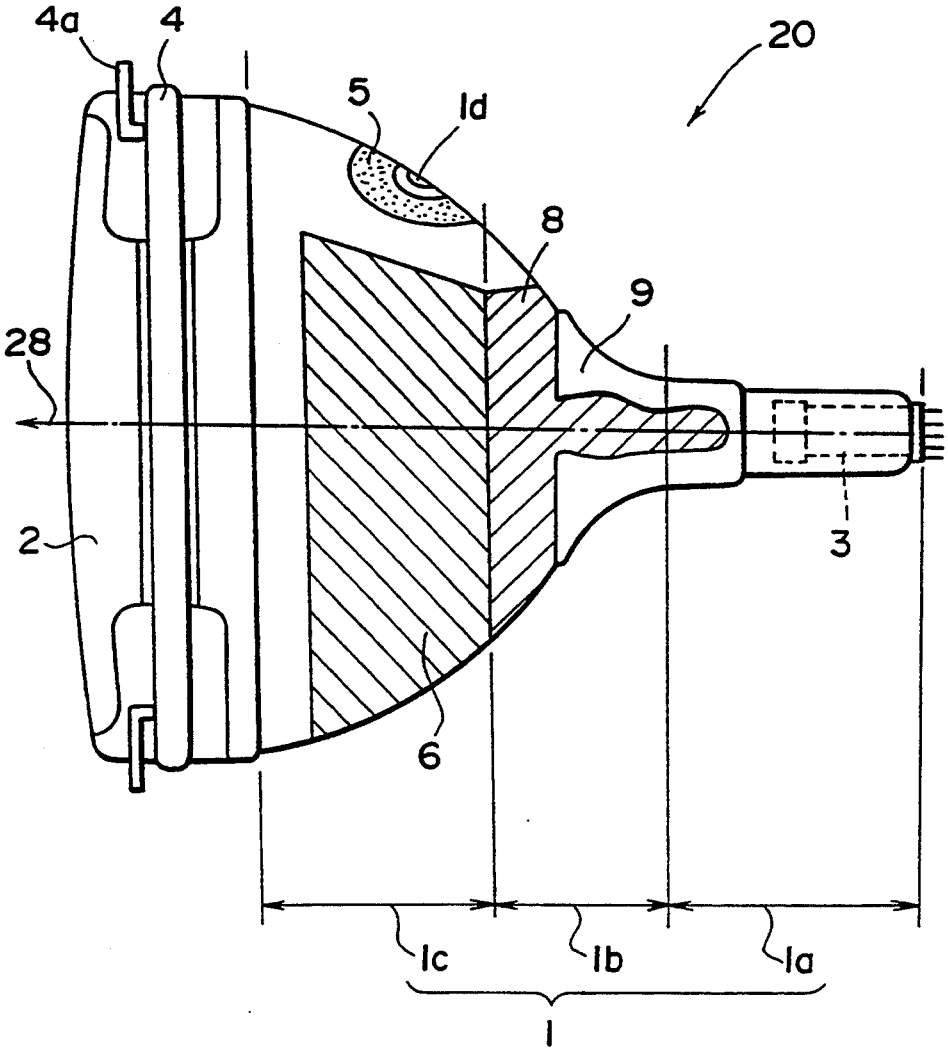
FIG. 4 is a side view, partly in section, of a first embodiment of a cathode-ray tube, before a deflection yoke is mounted thereon, according to the present invention.
Figure 5:
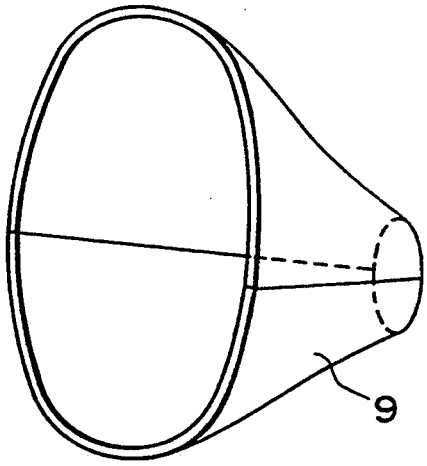
FIG. 5 is a perspective view of a conical insulation sheet used for the cathode-ray tube shown in FIG. 4.
Figure 6:
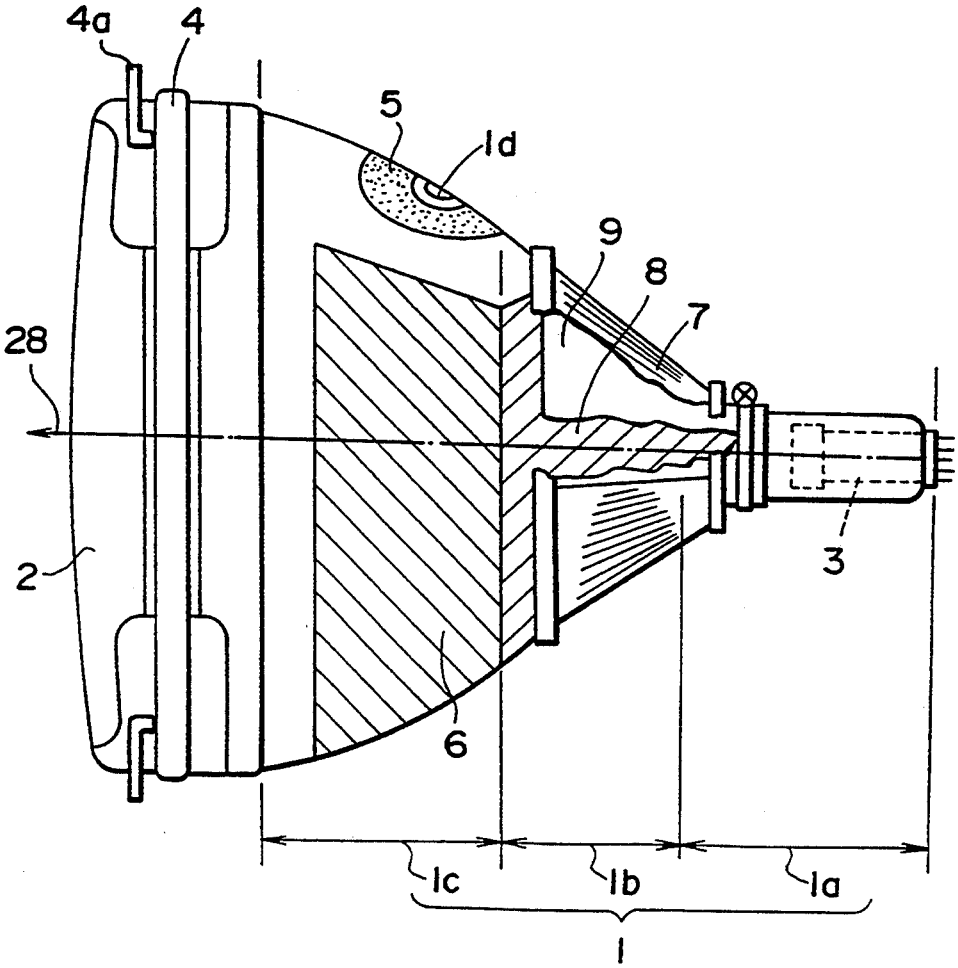
FIG. 6 is a side view, partially in broken, of the first embodiment of the cathode-ray tube shown in FIG. 4 after the deflection yoke is mounted thereon.

In FIGS. 4 to 6, there is shown the first embodiment of a cathode-ray tube according to the present invention, wherein the same numerals as those of the conventional cathode-ray tube shown in FIGS. 1 to 3 designate the same or corresponding parts. In this embodiment, a conductive film 8 for shielding an electric field is formed by applying graphite from the end of cone part 1*b* to the end of neck part 1*a* of a funnel part 1 so as to electrically contact with a conductive film 6. A conical insulation sheet 9 is provided on the neck part 1*a* and extends to the cone part 1*b* of the funnel part 1 in order to electrically isolate the conductive film 8 and a coil part of a deflection yoke 7. The conical insulation sheet 9 as shown in FIG. 5 is attached to the cone part 1*b* and the neck part 1*a* of the funnel part 1. On a glass bulb 20 constructed as described above, as shown in FIG. 6, the deflection yoke 7 is mounted on the insulation sheet 9.

Next, the operation of the cathode-ray tube described above will now be described in detail. By electrically grounding the conductive film 8, the conductive film 8 becomes an equipotential surface of 0 V. Since the conductive film 6 electrically conducts to the conductive film 8, a surface or plane having an electric field shielding effect is formed in the open front area of the deflection yoke 7 so as to reduce the alternating electric field irradiated from the deflection yoke 7 to the front surface of a face panel through the funnel part 1. Further, since the insulation sheet 9 is interposed between the coil part of the deflection yoke 7 and the conductive film 8, the coil part of the deflection yoke 7 is electrically isolated from the conductive film 8 and a problem such as a discharge or the like can not happen.

In this embodiment, as described above, the conductive film 8 for shielding the electric field is formed from the neck part 1*a* to the end of the cone part 1*b* of the funnel part 1 of the glass bulb 20 so as to electrically connect with the conductive film 6, and the deflection yoke 7 is arranged on the conductive film 8 through the insulation sheet 9. The conductive film 8 is grounded in order to form the equipotential surface of 0 V in front of the deflection yoke 7. Hence, due to this equipotential surface, the alternating electric field irradiated by the deflection yoke 7 and permeating the funnel part can be reduced by approximately 40% as compared with the conventional cathode-ray tube.

Figure 7:
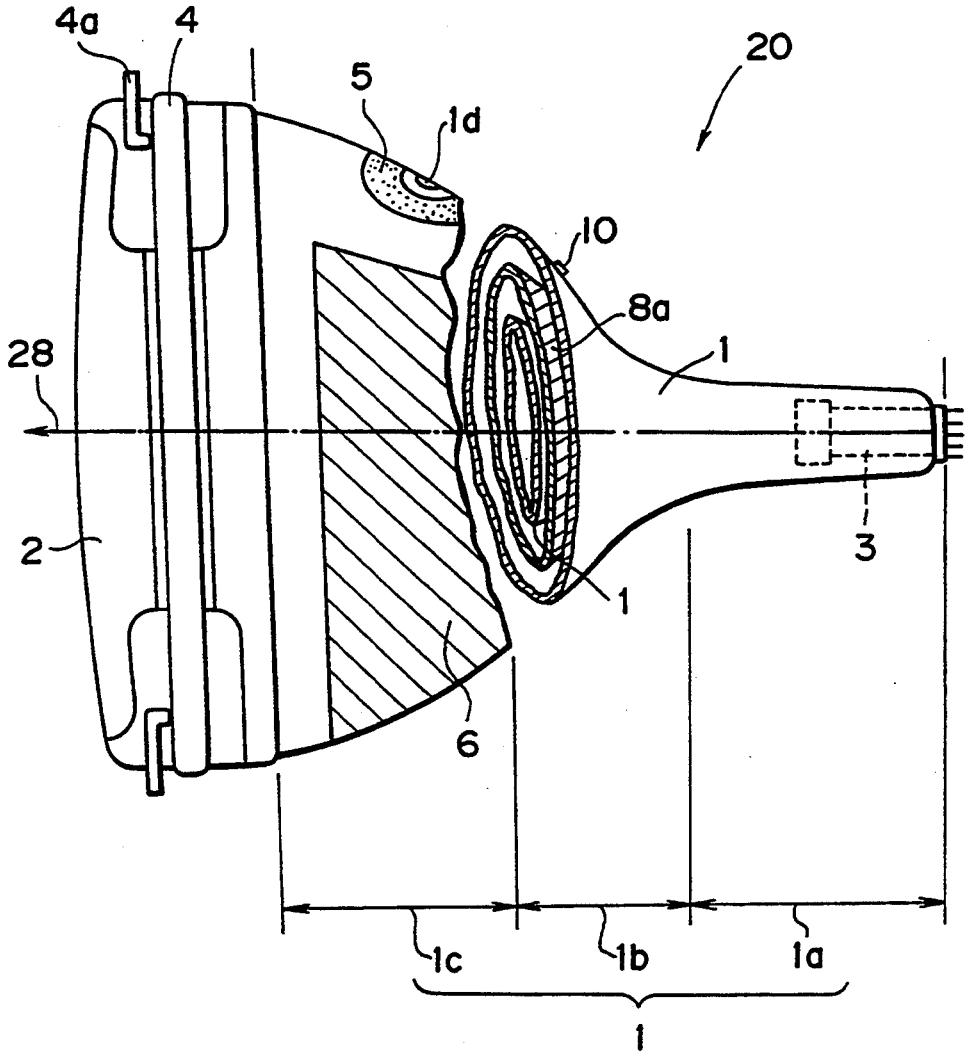
FIG. 7 is a side view, partly in broken, of a second embodiment of a cathode-ray tube according to the present invention.

In FIG. 7, there is shown the second embodiment of a cathode-ray tube according to the present invention, having the same construction as the first embodiment shown in FIGS. 4 to 6, except that a conductive material is formed inside the funnel part 1. That is, a conductive material 8*a* such as aluminum foil for shielding the electric field is embedded within the funnel part 1 so as to cover the open front surface of the deflection yoke 7. A metallic conducting button 10 is provided on the external surface of the funnel part 1 so as to contact with the conductive film 8*a* but so as not to contact with the coil of the deflection yoke 7.

Next, the operation of the above-described cathode-ray tube will now be described in detail. By electrically grounding the conducting button 10, the conductive film 8*a* becomes an equipotential surface of 0 V, and a shield plane having an electric field shielding effect is formed in front of the opening part of the deflection yoke 7. Hence, the alternating electric field irradiated by the deflection yoke 7 and permeating the funnel part can be reduced by approximately 40% as compared with the conventional cathode-ray tube. Further, since the conductive film 8*a* is embedded in the glass constituting the funnel part 1 in a sandwich-like form the conductive film 8*a* is electrically isolated from the external part, and no problem such as a discharge between the conductive film 8*a* and the deflection yoke 7 or the like can occur. Thus, in this embodiment, an insulation member for insulating the conductive film 8*a* from the deflection yoke 7 is not required.

Figure 8:
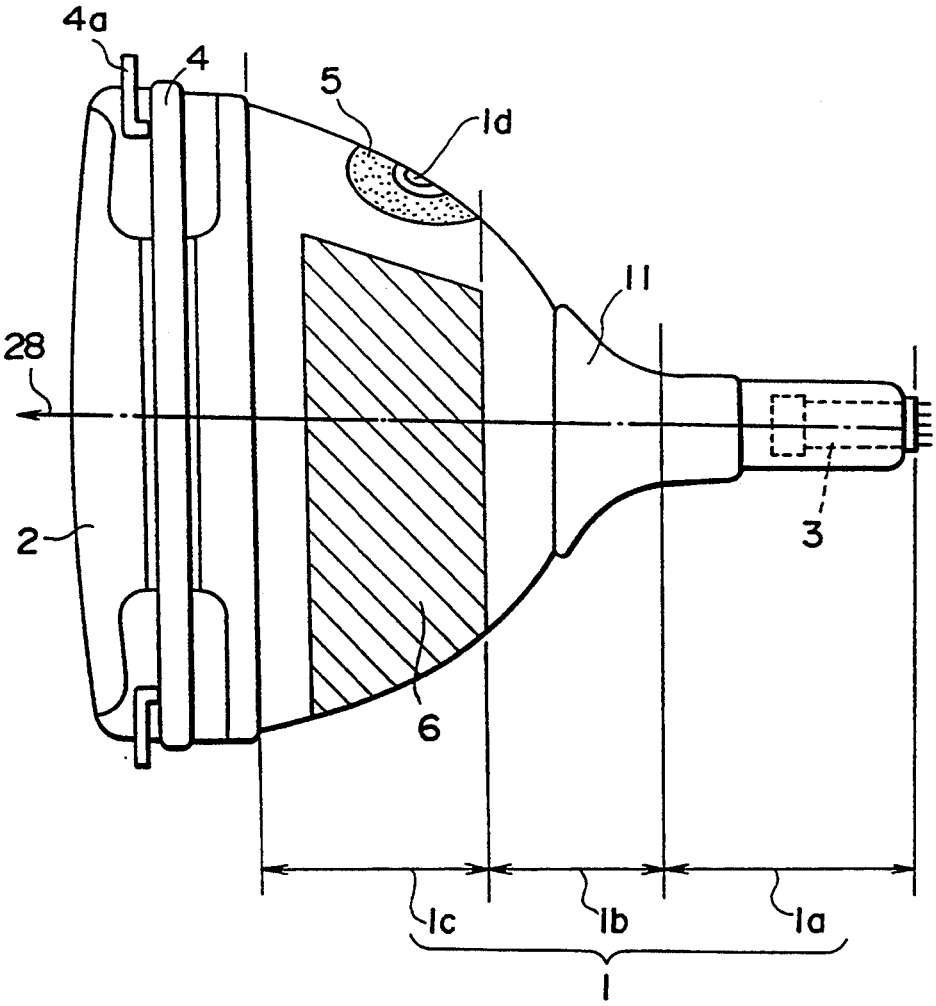
FIG. 8 is a side view of a third embodiment of a cathode-ray tube, before a deflection yoke is mounted thereon, according to the present invention.
Figure 9:
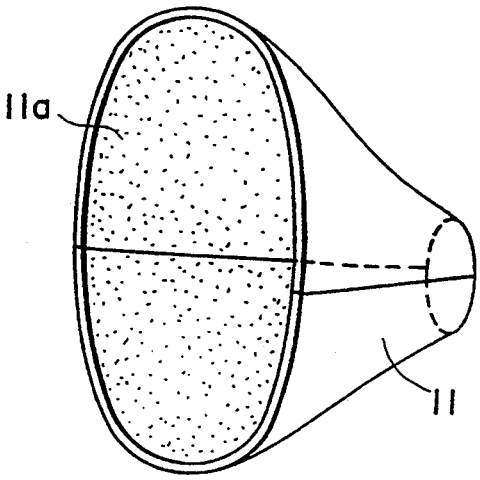
FIG. 9 is a perspective view of a conical insulation body used for the cathode-ray tube shown in FIG. 8.
Figure 10:
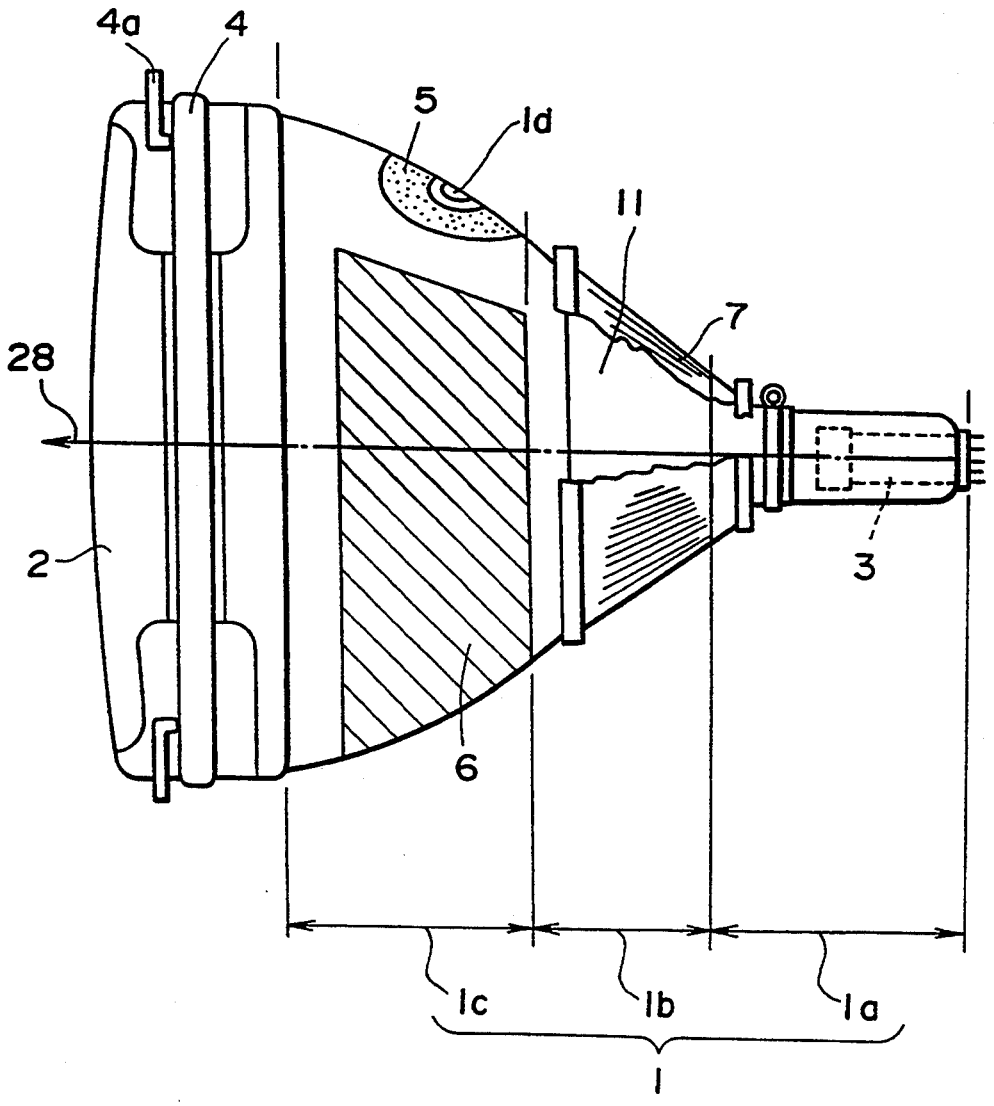
FIG. 10 is a side view, partly in section, of the third embodiment of the cathode-ray tube shown in FIG. 8 after the deflection yoke is mounted thereon.

In FIGS. 8 to 10, there is shown the third embodiment of a cathode-ray tube according to the present invention, having the same construction as the first embodiment shown in FIGS. 4 to 6, except that a conical insulation member 11 having a conductive film 11*a* formed on its internal surface is interposed between the funnel part 1 and the deflection yoke 7 from the cone part 1*b* to the neck part 1*a* of the funnel part 1 so as to cover the internal open part of the deflection yoke 7. As example of the conductive film, the graphite is applied on the internal surface of the conical insulation member 11.

Next, the operation of the above-described cathode-ray tube will now be described in detail. By electrically grounding the conductive film 11*a* formed on the internal surface of the conical insulation member 11, the conductive film 11*a* becomes an equipotential surface of 0 V, and a shield plane having an electric field shielding effect is formed in front of the opening part of the deflection yoke 7. Thus, the alternating electric field irradiated by the deflection yoke 7 and permeating the funnel part can be reduced by approximately 40% as compared with the conventional cathode-ray tube. Further, since the conductive film 11*a* is electrically isolated from the coil part of the deflection yoke 7, and thus the problem such as a discharge between the conductive film 11*a* and the deflection yoke 7 or the like can not be caused. In this embodiment, although the graphite as the conductive material is applied on the internal surface of the conical insulation member 11, a conductive metal such as aluminum or the like can be also applied onto the internal surface of the conical insulation member 11 by vapor deposition or the like with the same results and effects. In this case, as described above, by mounting the insulation member having the internal conductive film or the like, the alternating electric field can be effectively reduced without applying a particular processing to the glass bulb 20 and the deflection yoke 7.

Figure 11:
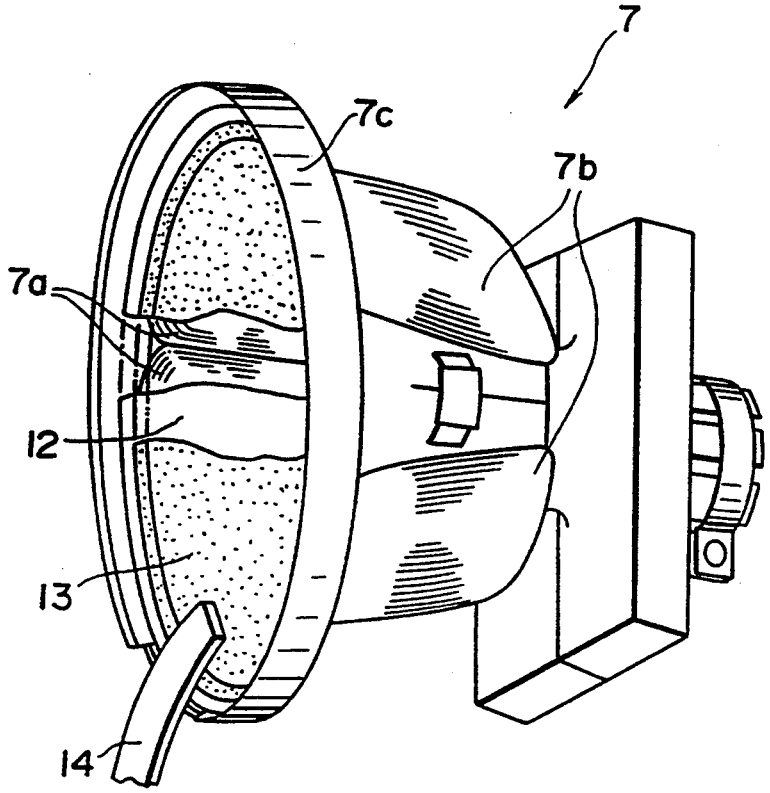
FIG. 11 is a perspective view, partially in section, of a deflection yoke used for a fourth embodiment of a cathode-ray tube according to the present invention.

In FIG. 11, there is shown a deflection yoke 7 of the fourth embodiment of a cathode-ray tube according to the present invention. In this embodiment, as shown in FIG. 11, a conductive film 13 is formed in front of the opening part of the deflection yoke 7 via an insulation film 12. That is, the deflection yoke 7 includes the insulation film 12 for covering the horizontal deflection coil 7*a* from the inside and the conductive film 13 of graphite or the like is applied on the internal surface of the insulation film 12. Further, a conducting tape 14 is attached to the conductive film 13 and is extended outside the deflection yoke 7. In FIG. 11, although the part of the horizontal deflection coil 7*a* is exposed for readily understanding the structure, actually, the insulation film 12 covers the entire inner surface of the horizontal deflection coil 7*a*, and the conductive film 13 is applied onto the whole internal surface of the insulation film 12.

Next, the operation of the above-described cathode-ray tube will now be described in detail. By electrically grounding the conductive film 13 formed on the internal surface of the conical insulation film 12 by the conducting tape 14, the conductive film 13 becomes an equipotential surface of 0 V, and a shield plane having an electric field shielding effect is formed in front of the opening part of the deflection yoke 7. Hence, the alternating electric field irradiated by the deflection yoke 7 and permeating the funnel part can be reduced by approximately 40% as compared with the conventional cathode-ray tube. Further, since the insulation film 12 is interposed between the horizontal deflection coil 7*a* and the conductive film 13, both can be electrically isolated from each other, and thus the problem such as a discharge between the conductive film 13 and the deflection yoke 7 or the like can not occur.

Figure 12:
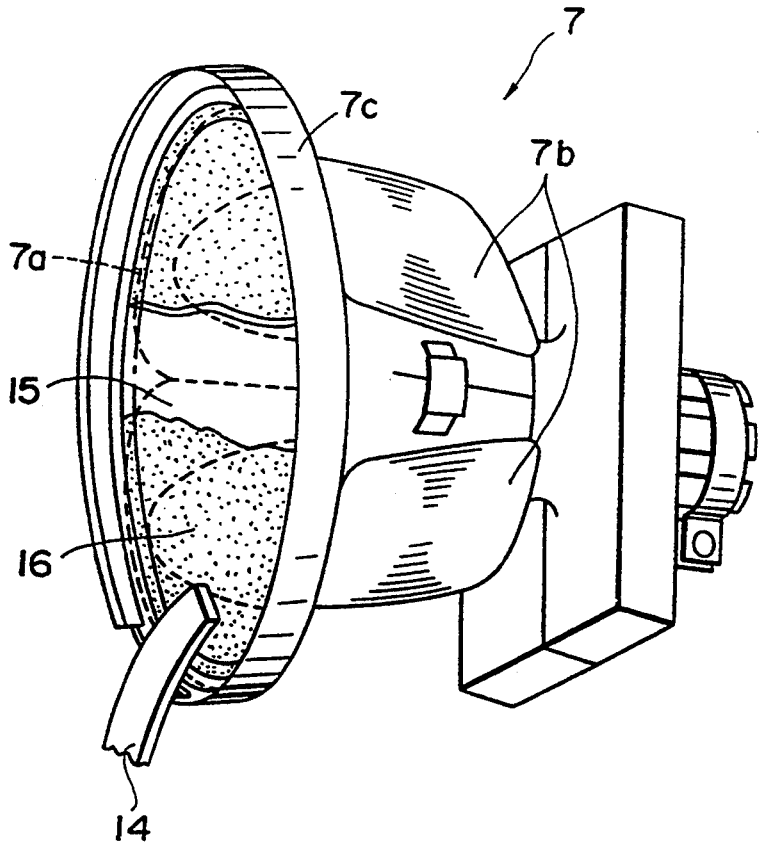
FIG. 12 is a perspective view, partly in section, of a deflection yoke used for a fifth embodiment of a cathode-ray tube according to the present invention.
Figure 13:
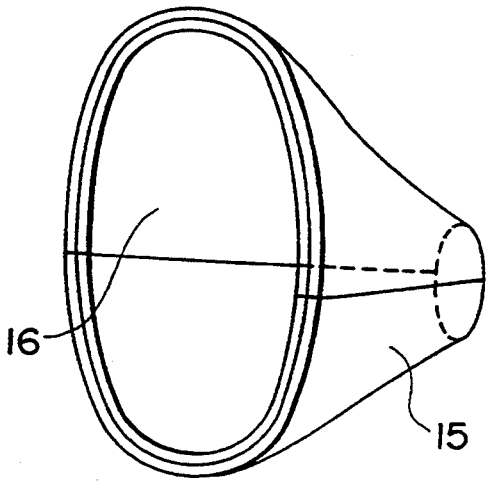
FIG. 13 is a perspective view of a conical insulation body used for the fifth embodiment of the cathode-ray tube according to the present invention.

In FIGS. 12 and 13, there is shown a deflection yoke 7 of the fifth embodiment of a cathode-ray tube according to the present invention. In this embodiment, a conical insulation member 15 having a conductive film 16 of graphite or the like applied onto the internal surface thereof, as shown in FIG. 13 is mounted in front of the opening part of the deflection yoke 7, as shown in FIG. 12. Further, a conducting tape 14 is attached to the conductive film 16 and is extended outside the deflection yoke 7.

Next, the operation of the above-described cathode-ray tube will now be described in detail. By electrically grounding the conductive film 16 formed on the internal surface of the conical insulation member 15 by the conducting tape 14, the conductive film 16 becomes an equipotential surface of 0 V, and a shield plane having an electric field shielding effect is formed in front of the opening part of the deflection yoke 7. Hence, the alternating electric field irradiated by the deflection yoke 7 and permeating the funnel part can be reduced by approximately 40% as compared with the conventional cathode-ray tube. In this instance, the deflection yoke 7 and the insulation member 15 can be separately produced, and the latter can be readily mounted to the former. Further, since the insulation member 15 is interposed between the horizontal deflection coil 7*a* and the conductive film 16, both the members can be electrically isolated from each other, and thus the problem such as a discharge between the conductive film 13 and the deflection yoke 7 or the like can not occur.

Figure 14:
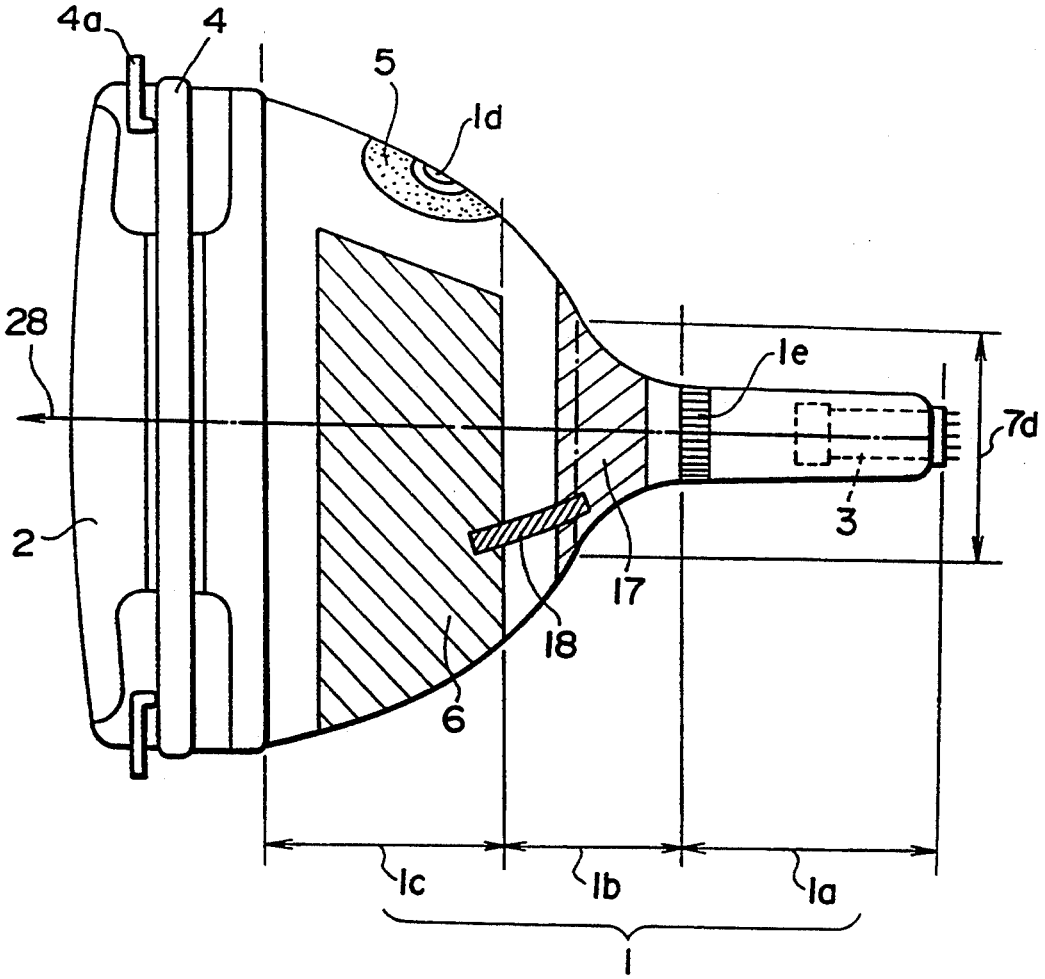
FIG. 14 is a side view of a sixth embodiment of a cathode-ray tube, before a deflection yoke is mounted thereon, according to the present invention.
Figure 15:
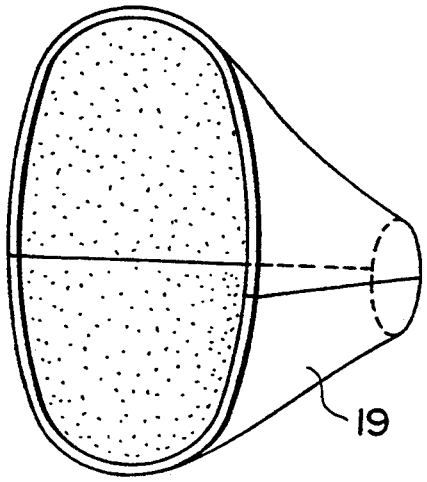
FIG. 15 is a perspective view of a conical insulation body used for the cathode-ray tube shown in FIG. 14.
Figure 16:
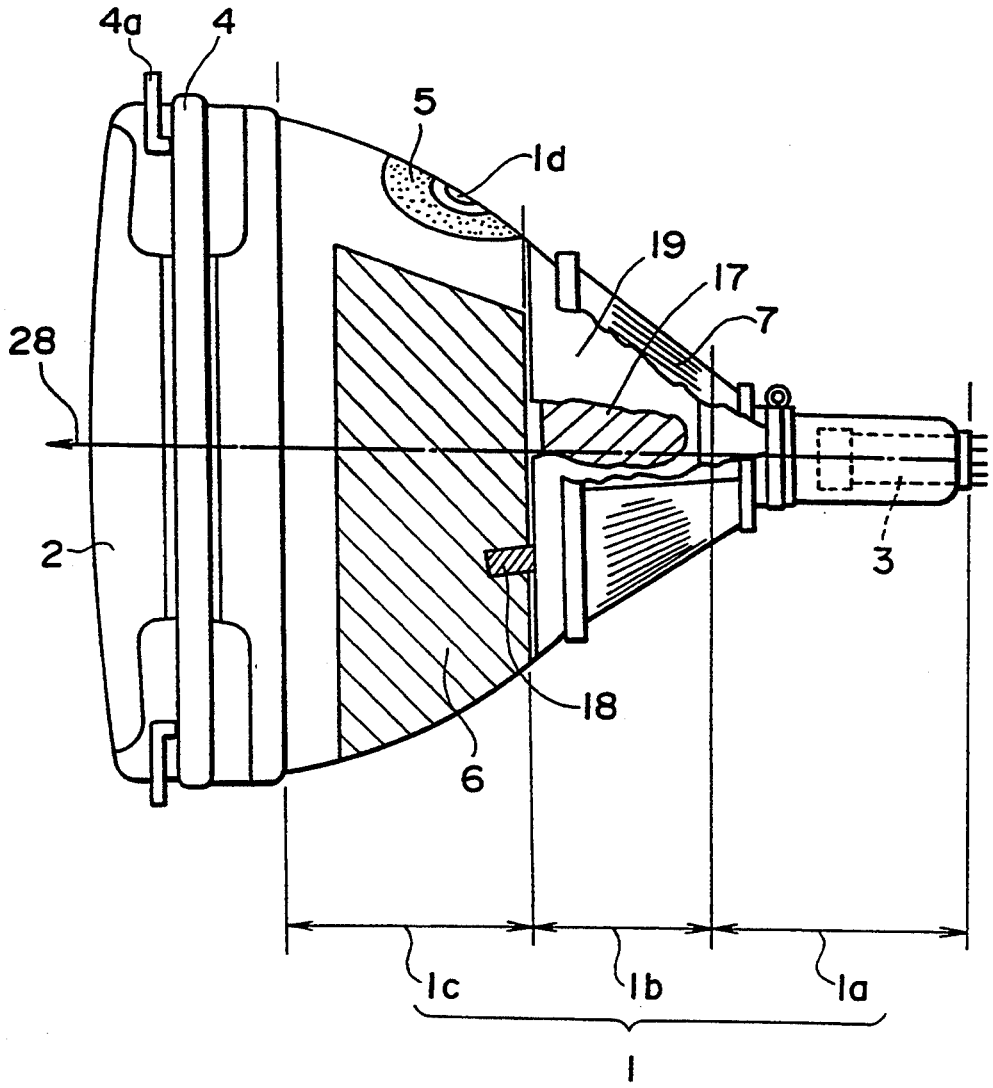
FIG. 16 is a side view, partly in section, of the sixth embodiment of the cathode-ray tube shown in FIG. 14 after the deflection yoke is mounted thereon.

In FIGS. 14 to 16, there is shown the sixth embodiment of a cathode-ray tube according to the present invention, having the same construction as the first embodiment shown in FIGS. 4 to 6, except that a conductive film 17 for shielding the electric field is formed in a predetermined portion of the cone part 1*b* of the funnel part 1 by applying the graphite separate from the neck part 1*a* and the neck seal line le. More specifically, in the cone part 1*b*, the conductive film 17 is formed in the area surrounded by a first circular circumference having a diameter at least larger than the maximum diameter 7*d* of the horizontal deflection coil 7*a* of the deflection yoke 7 and a second circular circumference at a position shifted at least 10 mm from the neck seal line 1*e* toward the panel part 2 in the direction of the tube axial 28 on the external surface of the funnel part 1. Also, the conductive film 17 is connected to the conductive film 6 by a conducting tape 18 to ground it. A conical insulation member 19 to be mounted on the conductive film 17 is designed so as to entirely cover the conductive film 17, as shown in FIG. 15. Further, as shown in FIG. 16, the conical insulation member 19 is interposed between the conductive film 17 and the coil of the deflection yoke 7 fixed on the funnel part 1. The maximum diameter 7*d* of the horizontal deflection coil 7*a* of the deflection yoke 7 in FIG. 14 indicates the maximum diameter of the horizontal deflection coil 7*a* cut in section taken along the X-Y plane in FIG. 3, and hence, when the X-Y section is an ellipse, the maximum diameter 7*d* indicates the long diameter of the ellipse.

Next, the operation of the above-described cathode-ray tube will now be described in detail. By electrically grounding the conductive film 17 by the conducting tape 18 conducting to the conductive film 6, the conductive film 17 becomes an equipotential surface of 0 V, and a shield plane having an electric field shielding effect is formed in front of the opening part of the deflection yoke 7. Hence, the alternating electric field irradiated by the deflection yoke and permeating the funnel part can be reduced by approximately 40% as compared with the conventional cathode-ray tube. Further, since the front end of the conductive film 17, i.e., the panel side end of the same is the larger circular circumference than the maximum diameter *7d* of the horizontal deflection coil of the deflection yoke 7, the shield plane for sufficiently shielding the alternating electric field irradiated from the front side of the deflection yoke 7 can be formed. Also, since the conductive film 17 is formed to the position shifted at least 10 mm from the neck seal line 1*e* in the panel side direction, the neck seal line part having a thin glass thickness and thus a weak strength is kept to be a large electric resistance. Thus, it is prevented to concentrate the electric field to the local low resistance position to maintain the reliability of the cathode-ray tube. Further, since the insulation member 19 is interposed between the coil part of the deflection coil 7 and the conductive film 17, both the members can be electrically isolated from each other, and thus the problem such as a discharge between the conductive film 18 and the deflection yoke 7 or the like can not occur.

Figure 17:
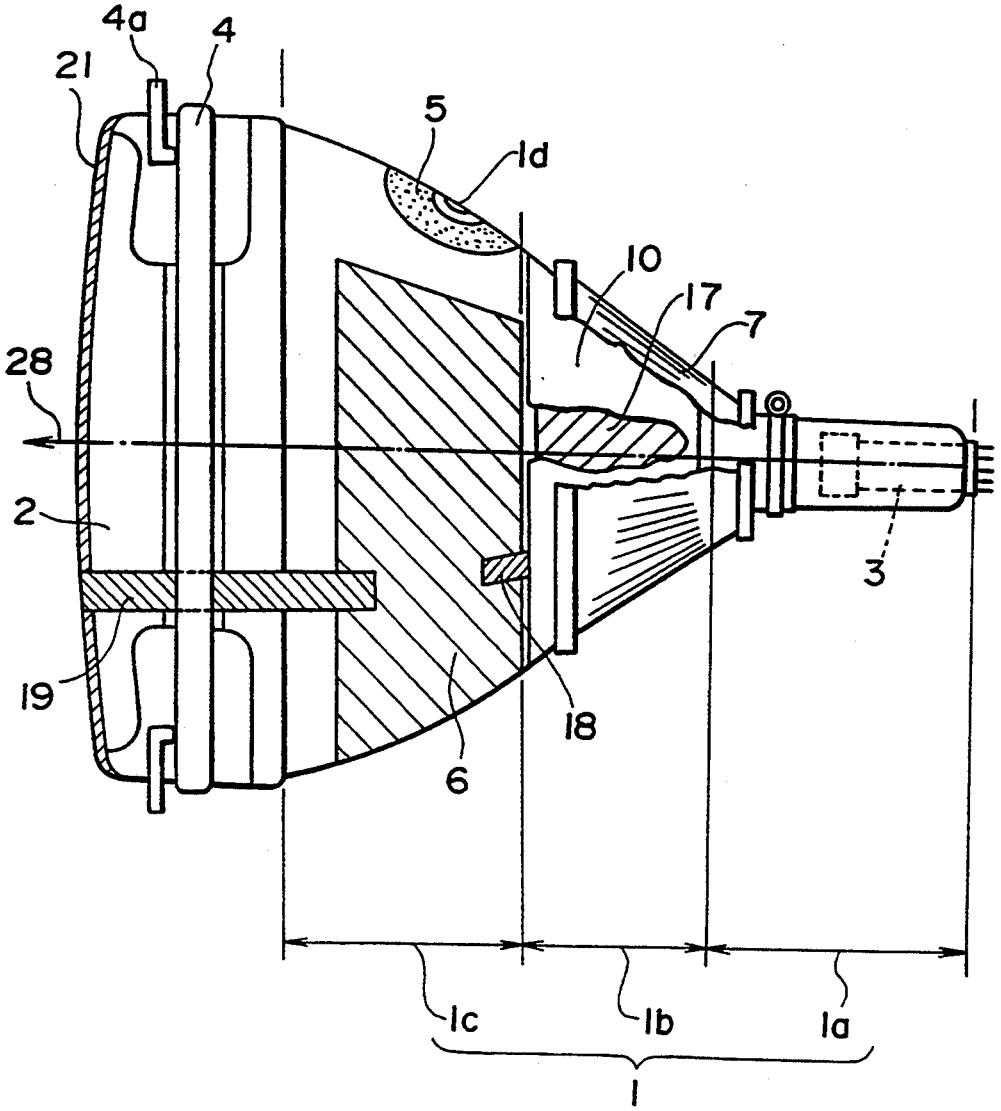
FIG. 17 is a side view, partially in broken, of a seventh embodiment of a cathode-ray tube according to the present invention.

In FIG. 17, there is shown the seventh embodiment of a cathode-ray tube according to the present invention, having the same construction as the sixth embodiment shown in FIGS. 14 to 18, except that a transparent conductive film 21 is further formed on the external surface of the panel part 2 and is coupled to the conductive film 6 by a conducting tape 19 to ground it so that the alternating electric field permeating the panel part 2 is effectively reduced.

Next, the operation of the above-described cathode-ray tube will now be described in detail. In addition to the operation of the sixth embodiment described above, by electrically grounding the transparent conductive film 21 formed on the external surface of the panel part 2 by the conducting tape 19 conducting to the conductive film 6, the transparent conductive film 21 becomes an equipotential surface of 0 V, and a shield plane having an electric field shielding effect is formed on the front surface of the panel part 2 to raise the reduction effect of the alternating electric field. Hence, the alternating electric field irradiated by the deflection yoke 7 can be more effectively reduced by approximately 70 to 80% as compared with the conventional cathode-ray tube.

Figure 18:
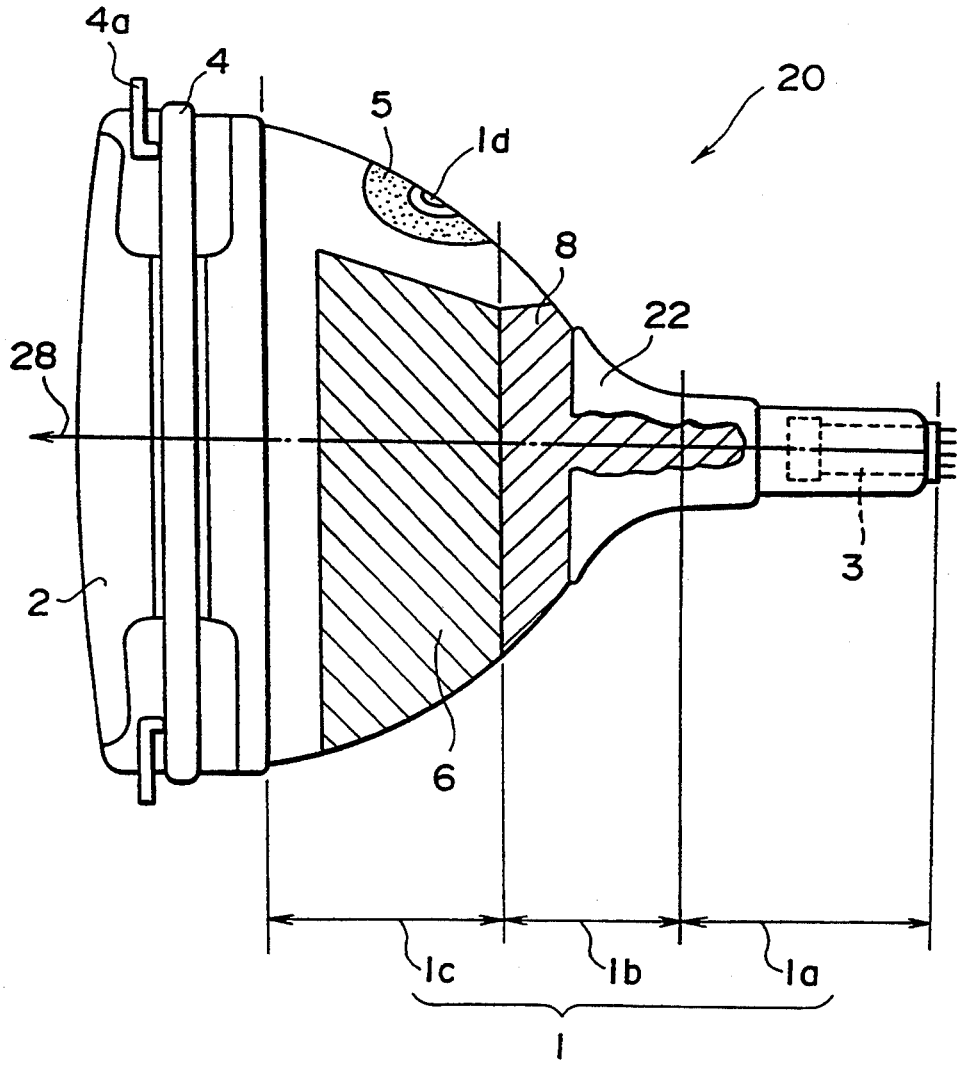
FIG. 18 is a side view, partly in section, of an eighth embodiment of a cathode-ray tube according to the present invention.

In FIG. 18, there is shown the eighth embodiment of a cathode-ray tube according to the present invention, having the same construction as the first embodiment shown in FIGS. 4 to 6, except that an insulation sheet 22 having a heat contraction property is used. In this embodiment, as shown in FIG. 18, the insulation sheet 22 having a heat contraction property is mounted on the funnel part 1 so as to extend over the cone part 1*b* and the neck part 1*a*, and then a heat treatment of the insulation sheet 22 is carried out by using, for example, a dryer or the like to readily and exactly perform a close contact with the funnel part 1. As a result, the reliability of the electric insulation property can be raised. In this case, the same effects and advantages as those of the first embodiment can be obtained.

According to the present invention, it is apparent that a transparent conductive film 21 can be further formed on the external surface of the panel part 2 and be grounded to expect the same effect resulted in the seventh embodiment in the first to sixth and eighth embodiments.

As described above, in the cathode-ray tube according to the present invention, an alternating electric field reduction means for reducing the alternating electric field irradiated from the deflection yoke to the front surface of the face panel through the funnel part is provided in a predetermined area extending from the cone part to the neck part where the deflection yoke is mounted, and the equipotential surface or the electric field shielding plane is formed in the internal circular circumference of the opening part of the deflection yoke. As a result, the alternating electric field irradiated from the deflection yoke to the front surface of the face panel through the funnel part and the face panel can be reduced to provide a cathode-ray tube having high safety.

According to the present invention, the transparent conductive film to be grounded can be further provided on the external surface of the face panel, and thus the electric field shielding plane is also formed on the front surface of the face panel. As a result, the alternating electric field permeating the face panel can be further reduced.

Furthermore, since the alternating electric field reduction means is separated at least a certain distance from the neck seal line of the funnel part in the panel side direction, the neck seal line part having a thin glass thickness and thus a weak strength is kept to be a large electric resistance, and thus it is prevented to concentrate the electric field to the local low resistance position to maintain the reliability of the cathode-ray tube.

Although the present invention has been described in its preferred embodiments with reference to the accompanying drawings, it it readily understood that the present invention is not restricted to the preferred embodiments and that various changes and modifications can be made by those skilled in the art without departing from the spirit and scope of the present invention.

What is claimed is:

1. A cathode-ray tube, comprising:

a funnel part, including a neck part for housing an electron gun arranged in a rear end of the cathode-ray tube, a funnel body part including a grounded first conductive film for adding a capacitance on part of an external surface, and a cone part for connecting the neck part and the funnel body part;

a face panel, including a fluorescent film on an internal surface of the face panel, connected to a front end of the funnel body part;

a deflection yoke for deflecting an electron beam irradiated by the electron gun, mounted on the funnel part from the cone part to the neck part; and alternating electric field reduction means for reducing an alternating electric field irradiated from the deflection yoke to a front surface of the face panel through the funnel part, wherein the alternating electric field reduction means includes a grounded second conductive member embedded in a predetermined area of the funnel part.

2. The cathode-ray tube of claim 1, further comprising a grounded third transparent conductive film mounted on an external surface of the face panel for reducing the alternating electric field irradiated to the front surface of the face panel through the funnel part by the deflection yoke.

3. The cathode-ray tube of claim 2, further comprising;

a conductive tape, directly connecting and mutually grounding the grounded first conductive film and the grounded transparent third conductive film, only one of the grounded first conductive film and the grounded transparent third conductive film being directly connected to ground.

4. A cathode-ray tube, comprising:

a funnel part including a neck part for housing an electron gun arranged in a rear end of the cathode-ray tube, a funnel body part including a grounded first conductive film for adding a capacitance on part of an external surface, and a cone part for connecting the neck part and the funnel body part;

a face panel, including a fluorescent film on an internal surface of the face panel, connected to a front end of the funnel body part;

a deflection yoke for deflecting an electron beam irradiated by the electron gun, mounted on the funnel part from the cone part to the neck part; and alternating electric field reduction means for reducing an alternating electric field irradiated from the deflection yoke to a front surface of the face panel through the funnel part, wherein the alternating electric field reduction means includes a conical insulator having a grounded second conductive film formed on an internal surface of the conical insulator, and is arranged to cover a predetermined area of the funnel part.

5. The cathode-ray tube of claim 4, further comprising a grounded third transparent conductive film mounted on an external surface of the face panel for reducing the alternating electric field irradiated to the front surface of the face panel through the funnel part by the deflection yoke.

6. The cathode-ray tube of claim 5, further comprising;

a conductive tape, directly connecting and mutually grounding the grounded first conductive film and the grounded transparent third conductive film, only one of the grounded first conductive film and the grounded transparent third conductive film being directly connected to ground.

7. A cathode-ray tube, comprising:

a funnel part, including a neck part for housing an electron gun arranged in a rear end of the cathode-ray tube, a funnel body part including a grounded first conductive film for adding a capacitance on part of an external surface, and a cone part for connecting the neck part and the funnel body part;

a face panel, including a fluorescent film on an internal surface of the face panel, connected to a front end of the funnel body part;

a deflection yoke for deflecting an electron beam irradiated by the electron gun, mounted on the funnel part from the cone part to the neck part; and alternating electric field reduction means for reducing an alternating electric field irradiated from the deflection yoke to a front surface of the face panel through the funnel part, and being provided on the funnel part at a predetermined area, extending from the cone part where the deflection yoke is set to the neck part, wherein the alternating electric field reduction means includes, an insulation layer formed on an internal surface of an opening part of the deflection yoke, and a grounded second conductive film formed on an internal surface of the insulation layer.

8. The cathode-ray tube of claim 7, further comprising a grounded third transparent conductive film mounted on an external surface of the face panel for reducing the alternating electric field irradiated to the front surface of the face panel through the funnel part by the deflection yoke.

9. The cathode-ray tube of claim 8, further comprising;

a conductive tape, directly connecting and mutually grounding the grounded first conductive film and the grounded transparent third conductive film, only one of the grounded first conductive film and the grounded transparent third conductive film being directly connected to ground.

10. A cathode-ray tube, comprising:

a funnel part, including a neck part for housing an electron gun, arranged in a rear end of the cathode-ray tube, a funnel body part including a grounded first conductive film for adding a capacitance on part of an external surface, and a cone part for connecting the neck part and the funnel body part;

a face panel including a fluorescent film on an internal surface of the face panel, connected to a front end of the funnel body part; and a deflection yoke for deflecting an electron beam irradiated by the electron gun, mounted on the funnel part from the cone part to the neck part, the deflection yoke including alternating electric field reduction means for reducing an alternating electric field irradiated by the deflection yoke, the alternating electric field reduction means, an insulation layer formed on an internal surface of an opening part of the deflection yoke, and a grounded second conductive film formed on an internal surface of the insulation layer.

11. A cathode-ray tube, comprising:

a funnel part, including a neck part for housing an electron gun, arranged in a rear end of the cathode-ray tube, a funnel body part including a grounded first conductive film for adding a capacitance on part of an external surface, and a cone part for connecting the neck part and the funnel body part;

a face panel, including a fluorescent film on an internal surface of the face panel, connected to a front end of the funnel body part;

a deflection yoke for deflecting an electron beam irradiated by the electron gun, mounted on the funnel part from the cone part to the neck part; and alternating electric field reduction means for reducing an alternating electric field irradiated from the deflection yoke to a front surface of the face panel through the funnel part, wherein the alternating electric field reduction means includes, a grounded second conductive film formed on a predetermined area of a surface of the funnel part, and an insulator formed on a surface of the grounded second conductive film for electrically isolating the deflection yoke from the conductive film and, wherein the grounded second conductive film is formed on an external surface of the cone part from a first area, having a larger diameter than an open diameter of a horizontal deflection coil of the deflection yoke, to a second area frontwards of a connection between the neck part and the cone part.

12. The cathode-ray tube of claim 11, further comprising a grounded third transparent conductive film mounted on an external surface of the face panel for reducing the alternating electric field irradiated to the front surface of the face panel through the funnel part by the deflection yoke.

13. The cathode-ray tube of claim 12, further comprising;

a conductive tape, directly connecting and mutually grounding the grounded first conductive film and the grounded transparent third conductive film, only one of the grounded first conductive film and the grounded transparent third conductive film being directly connected to ground.

14. A cathode-ray tube, comprising:

a funnel part, including a neck part for housing an electron gun, arranged in a rear end of the cathode-ray tube, a funnel body part including a grounded first conductive film for adding a capacitance on part of an external surface, and a cone part for connecting the neck part and the funnel body part;

a face panel, including a fluorescent film on an internal surface of the face panel, connected to a front end of the funnel body part;

a deflection yoke for deflecting an electron beam irradiated by the electron gun, mounted on the funnel part from the cone part to the neck part; and alternating electric field reduction means for reducing an alternating electric field irradiated from the deflection yoke to a front surface of the face panel through the funnel part, wherein the alternating electric field reduction means includes, a grounded second conductive film formed on a predetermined area of a surface of the funnel part, and an insulator formed on a surface of the grounded second conductive film for electrically isolating the deflection yoke from the conductive film and, wherein the insulator possesses a heat contraction property, and after mounting the insulator on the surface of the grounded second film the insulator is heated to be in close contact to the surface of the grounded second conductive film.

15. A cathode-ray tube, comprising:

a funnel part, including a neck part for housing an electron gun arranged in a rear end of the cathode-ray tube, a funnel body part including a grounded first conductive film for adding a capacitance on part of an external surface, and a cone part for connecting the neck part and the funnel body part;

a face panel, including a fluorescent film on an internal surface of the face panel, connected to a front end of the funnel body part;

a deflection yoke for deflecting an electron beam irradiated by the electron gun, mounted on the funnel part from the cone part to the neck part; and alternating electric field reduction means for reducing an alternating electric field irradiated from the deflection yoke to a front surface of the face panel through the funnel part, wherein the alternating electric field reduction means includes a conical insulator having a grounded second conductive film on an internal surface of the conical insulator, and is mounted on an internal surface of an opening part of the deflection yoke.

16. The cathode-ray tube of claim 15, further comprising a grounded third transparent conductive film mounted on an external surface of the face panel for reducing the alternating electric field irradiated to the front surface of the face panel through the funnel part by the deflection yoke.

17. The cathode-ray tube of claim 16, further comprising;

a conductive tape, directly connecting and mutually grounding the grounded first conductive film and the grounded conductive film and the grounded transparent third conductive film being directly connected to ground.

* * * * *